United States Patent [19]

Hira et al.

[11] Patent Number: 4,509,874

[45] Date of Patent: Apr. 9, 1985

[54] APPARATUS FOR SECURING A TYPEWRITER

[75] Inventors: Yutaka Hira; Yoshitaka Ukai; Yoshihide Akuzawa, all of Shizuoka; Osamu Aoki, Numazu; Saburo Shimatani, Funabashi, all of Japan

[73] Assignee: Tokyo Electric Co., Ltd., Tokyo, Japan

[21] Appl. No.: 508,064

[22] Filed: Jun. 24, 1983

[30] Foreign Application Priority Data

Mar. 3. 1983 [JP] Japan ..... 58-30972[U]

[51] Int. Cl.[3] ..... B41J 29/02

[52] U.S. Cl. ..... 400/691; 312/208

[58] Field of Search ..... 400/691, 693; 312/208; 109/51, 52; 248/551, 553

[56] References Cited

U.S. PATENT DOCUMENTS

| | | | |
|---|---|---|---|
| 1,713,594 | 5/1929 | Campbell | 312/208 |
| 1,909,060 | 5/1933 | Kurowski | 400/691 X |
| 2,075,021 | 3/1937 | Colon | 400/691 X |
| 3,712,633 | 1/1973 | Schadlich | 279/1 B |
| 4,029,370 | 6/1977 | Ziegel et al. | 109/51 X |
| 4,330,219 | 5/1982 | Miyasaka et al. | 400/691 X |

*Primary Examiner*—Edgar S. Burr
*Assistant Examiner*—John A. Weresh
*Attorney, Agent, or Firm*—Frishauf, Holtz, Goodman & Woodward

[57] ABSTRACT

An apparatus for securing a typewriter, includes a locking device for locking an outer case in a closed position and a fastening device for fastening a bottom plate of the case to a mounting base. When opened, the cover permits a portion of the bottom plate to be exposed. The fastening device is brought, from inside the case, into engagement with the bottom plate of the case through the exposed portion of the bottom plate, thereby locking the typewriter to the mounting base. The fastening device for the bottom plate cannot be released unless the locking device is unlocked by a key to open the cover. Accordingly, only a keyholder can unlock the locking device, thus preventing the typewriter from being stolen. Further, since the fastening device is engaged with the bottom plate of the typewriter case, the outer appearance of the typewriter is not degraded.

7 Claims, 4 Drawing Figures

APPARATUS FOR SECURING A TYPEWRITER

BACKGROUND OF THE INVENTION

This invention relates to an apparatus for securing a typewriter onto a mounting base for preventing it from being stolen.

There are many instances where typewriters are stolen, especially those placed on exhibition or display for sale, or even those on desks at offices or typing schools. In order to prevent the typewriter from being stolen, it has been suggested to provide a durable piece on the typewriter in such a manner that the piece protrudes from the outer periphery of the typewriter, and then to fix this piece onto the desk by means of bolts or the like. In this case, however, not only would it be possible easily to dismount the typewriter from the desk by the use of a tool, but is there also the drawback that the outer appearance of the typewriter is degraded due to the existence of the piece or the bolts protruded from the typewriter.

SUMMARY OF THE INVENTION

An object of the invention is to provide an apparatus for securing a typewriter for theft-prevention, which makes it impossible for another person to release the fixed typewriter and which causes no damage to the outer appearance of the typewriter.

According to an aspect of the invention, there is provided an apparatus for securing onto a typewriter-mounting base a typewriter comprised of a case which includes a bottom plate and a wall having an opening, and in which case a body with a printing function is received, and a cover which is attached to said case and closes said opening, so that when said cover is opened, a portion of said bottom plate is exposed, the apparatus comprising locking means for locking said cover to said case by means of a lock in a state wherein said cover is closed, and fastening means which, when said cover is opened, fastens the exposed portion of said bottom plate onto the mounting base through said opening, on a dismountable basis.

DETAILED DESCRIPTION OF THE PREFERRED EMBODIMENT

Figure 1:
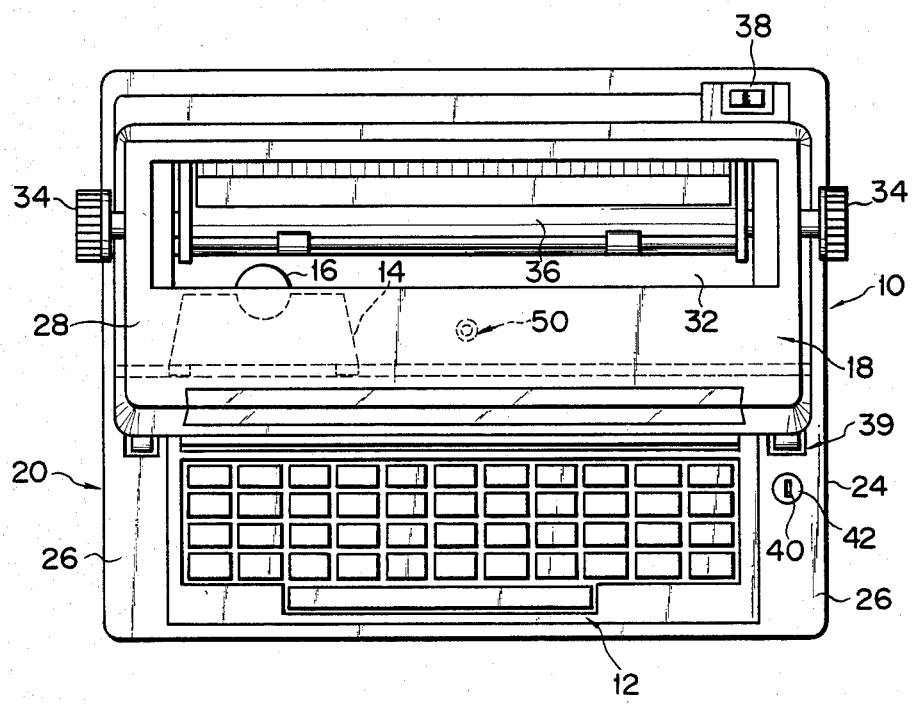
FIG. 1 is a plan view of a typewriter fixed onto a desk using an apparatus according to an embodiment of the invention.
Figure 2:
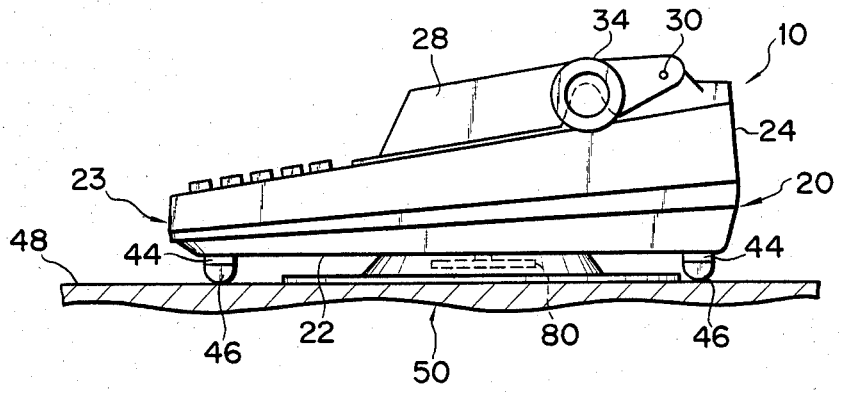
FIG. 2 is a side view of the typewriter shown in FIG. 1.

As shown in FIGS. 1 and 2, an electric typewriter 10 has a case 20 in which a main body 18 having a keyboard 12, a ribbon cassette 14 and a typing element for printing the characters by striking and a drive mechanism (not shown) for the typing element are received. The case 20 is comprised of a bottom plate 22 and a wall 23 which has a side wall 24, and an upper plate 26 made integral with the side wall 24 and arranged to enclose the keyboard 12. On the side of the upper plate 26 or keyboard 12, an openable cover 28 is provided for replacement of a typewriter ribbon received in the ribbon cassette 14. The cover 28 has its rear portion opposite to the keyboard 12 side rockably supported, by means of a hinge pin 30, on a portion of the upper plate 26 of the case 20. The cover 28 has at its substantially central portion an opening 32 for insertion or removal of a sheet of paper to be typewritten. A pair of knobs 34 for manipulating the insertion and removal of the sheet of paper are provided in such a manner as to protrude from both sides of the cover 28. The knobs 34 are coaxially connected to both ends of a drum (platen) 36 used to press a typewriting sheet against the typing element. A main switch 38 for starting the electric typewriter is disposed at a rear portion of the case 20.

A locking device (a locking means) 39 for securely locking the cover 28 to the case 20 is disposed at one portion of the upper plate 26 located on either side of the keyboard 12. The locking device 39 is provided with a key portion 42 formed with a key groove 40 for insertion of a key at the time of locking and unlocking the locking device 39.

Four legs 46 formed of rigid material are provided at four corners of the bottom plate 22 of the case 20 through cushions 44, respectively, the bottom plate 22 being placed on a mounting base 48 with a specified space allowed to exist therebetween. Between the mounting base 48 and the bottom plate 22, a fastening device 50 is disposed for reliably fixing the typewriter 10 onto the mounting base 48 to be immovable.

Figure 3:
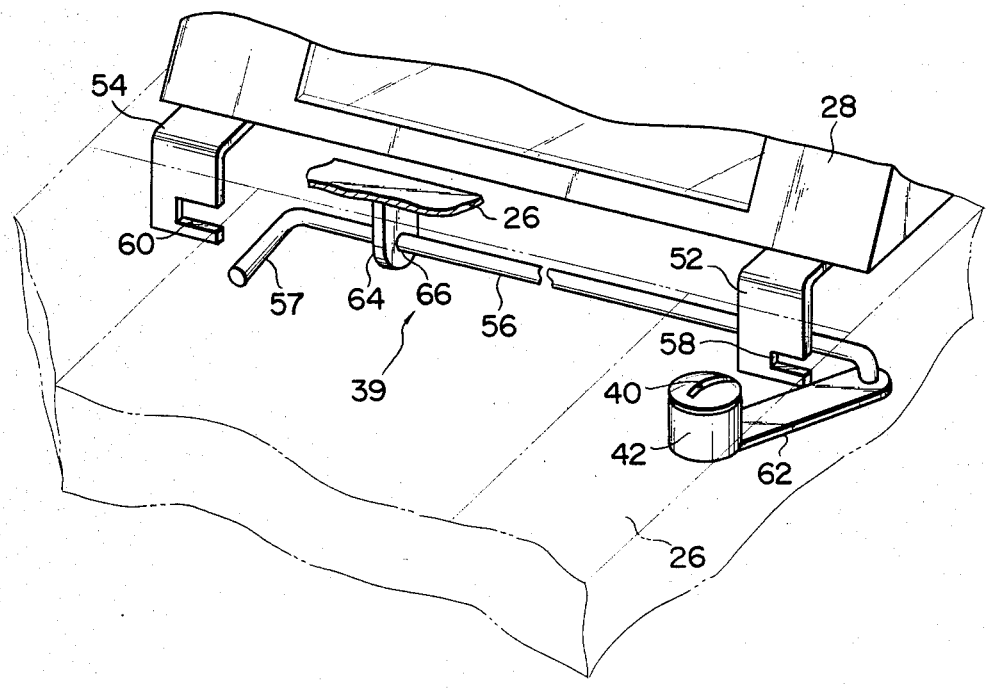
FIG. 3 is an enlarged perspective view of a locking device of the securing apparatus used in FIG. 1.

As shown in FIG. 3, the locking device 39 has a pair of tongues 52 and 54 which are provided on both sides of the portion of the cover 28 closer to the keyboard 12, extending in the depthwise direction of the case 20. The tongue members 52 and 54 are each provided at one side with grooves 58 and 60 engageable with an arm 62 and one end portion 57 of a rod 56, respectively. The grooves 58 and 60 are formed in a direction transverse to the direction in which the cover 28 is rocked, substantially at right angles thereto so that the grooves are located substantially at the central positions of the tongue members, respectively. The rod 56 is connected at the other end portion to a tip end portion of the arm 62, a base end portion of which is connected to the key portion 42 so that, when the key (not shown) is inserted by an operator into the key groove 40 and turned, the base end portion may be interlocked with the key. The rod 56 is supported at its intermediate portion by a supporting piece 64 fixed to the upper plate 26 of the case 20. The rod 56 slides through a hole 66 formed in the supporting piece 64.

Figure 4:
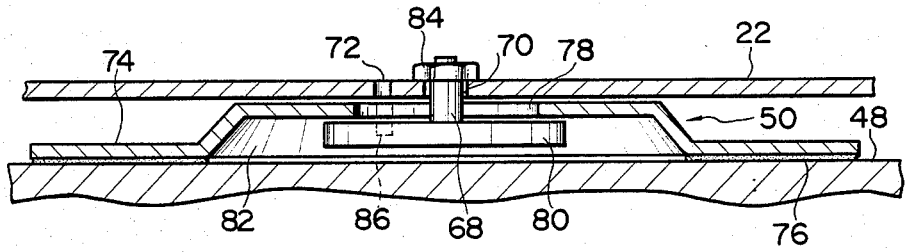
FIG. 4 is an enlarged perspective view of a fastening device of the securing apparatus used in FIG. 1.

The fastening device or means 50 for fixing the bottom plate 22 of the electric typewriter to the mounting base 48 will now be described in detail with reference to FIG. 4.

The bottom plate 22 is formed with a fastening bore (third bore) 70 for insertion thereinto of a shaft (bolt) 68, at a position located substantially at a central portion between the drum (platen) 36 and a keyboard 12 and also located substantially at a middle portion of the travel locus of the ribbon cassette. At a position adjacent to the fastening bore 70, there is formed an insertion bore (second bore) 72 permitting a tip end portion of, for example, a driver to be inserted therethrough. A fastening member 74 having a convex central portion is firmly secured, by means of an adhesive agent 76, onto the mounting base 48. The convex portion of the fastening member 74 is formed substantially at its center with an adjusting bore (first bore) 78 for insertion therethrough of a shaft 68 formed with an external thread at one end portion thereof. The shaft 68 is adjustable within the adjusting bore 78. A circular plate 80 of larger diameter than that of the adjusting bore 78 formed in the fastening member 74, is formed at the lower end of the shaft 68 so as to be integral with this lower end. The circular plate 80 is at all times received within a space 82 defined between the fastening member 74 and the mounting base 48. The circular plate 80 has on its upper surface a recess 86 for receiving therein a tip end portion of a driver which has been inserted through the insertion bore 72 for the purpose of preventing, at the time of mounting a nut 84 onto the shaft 68, the rotation of the shaft 68 and the circular plate 80.

The operation of the securing apparatus for a typewriter according to the above-mentioned embodiment will now be described.

The fastening member 74 is firmly fixed in advance, by means of an adhesive agent, onto a desired position of the mounting base 48. Between the fastening member 74 and the mounting base 48, the circular plate 80 formed integrally with the shaft 68 is received in the above-mentioned space defined therebetween.

The cover 28 of the typewriter 10 is opened and the typewriter 10 is set so as to permit the shaft 68 to be fitted into the fastening bore 70 formed in the bottom plate 22. Next, the ribbon cassette and the typing element are moved to one side and a tool is inserted from between the keyboard 12 and the drum 36 to fit the nut 84 onto the shaft 68 for screw engagement, thereby fixing the typewriter 10 to the fastening member 74. At this time, the driver is inserted through the insertion bore 72 to prevent the rotation of the circular plate 80 at the time of fastening the nut onto the shaft 68. Since the adjusting bore 78 formed in the fastening member is made relatively large, it permits a slight movement of the typewriter 10.

Next, the cover 28 is closed and the tongue 54 is inserted into the case 20. Thereafter, the key (not shown) is inserted into the key groove 40 and is rotated. Thus, the arm 62 is swung in accordance with the rotation of the key portion 42 and is thus brought into engagement with the groove 58 formed in the tongue 52. Similarly, the rod 56 connected to the arm 62 is brought into fitting engagement with the groove 60 of the tongue 54. Accordingly, the cover 28 is locked in a closed state.

According to this embodiment, therefore, when it is desired to move the typewriter to another location, it is necessary to open the cover 28 by means of the key and then to unscrew the nut of the fastening device. In other words, the typewriter is double-locked, and simply by looking at it from the outside, it is not easy to locate the fastened portion of the typewriter. Consequently, it is possible to prevent another person from unlocking the locking device and releasing the fastening device to move or steal the typewriter.

Furthermore, since the typewriter is secured at the bottom plate of the case as well as at the interior of the cover, the outer appearance of the typewriter is not degraded.

Also, since the securing apparatus of this embodiment is removable, movement of the entire typewriter can be accomplished simply by opening the cover 28 by means of the key and removing the nut 84 of the fastening device 50. Then, the typewriter can be easily moved by the person possessing the key.

The present invention is not limited to the above-mentioned embodiment, but permits various modifications to be made without departing from the spirit of the invention.

The position for attaching the fastening device is not limited to the region between the keyboard and the drum (platen) but the invention permits the same effect to be obtained even if the position at which the fastening device is attached is located at the portion exposed when the cover is opened such as, for example, a portion located to the rear of the drum, or the portions located on both sides of the keyboard if the cover extends to both sides of the keyboard.

Further, in the above-mentioned embodiment, the fastening member is fixed, by means of an adhesive agent, onto the mounting base. But the invention is not so limited. For example, even when the fastening member is fixed onto the mounting base by means of a bolt or screw, the same effect is obtained.

In the above-mentioned embodiment, an electric typewriter was used as an example, but again the invention is not so limited. For example, even when the invention is applied to a manual typewriter, the same effect can be obtained.

Moreover, in the above-mentioned embodiment, a plug-in type key was used to fasten the locking device, but the invention is not limited thereto. For example, even when a number or dial key is used for fastening the locking device, the same effect can be obtained.

Further, in the above-mentioned embodiment, the fastening device includes a fastening member arranged to be fixed in advance onto the mounting base, but the invention is not limited thereto. For example, the fastening device may be of such a type wherein the bottom plate of the case of the typewriter is fixed directly onto the mounting base by means of a bolt. In this case, the mounting base is formed with a bore having an internal thread engageable with such a bolt.

What is claimed is:

1. An apparatus for securing to a typewriter-mounting base a typewriter comprised of a case which includes a bottom plate and a wall having an opening for accessing printing means contained in the case, a cover which is movably attached to said case for at least partly closing said opening, said cover when opened, exposing a portion of said bottom plate facing the printing means, comprising:

locking means on at least one of said case and said cover for locking said cover to said case in a state wherein said cover is closed; and p1 fastening means associated with said bottom plate for detachably fastening the portion of said bottom plate which is exposed only when said cover is opened on to the mounting base, said fastening means being accessible only when said cover is opened;

said fastening means comprising a fastening member arranged to be fixed in advance at a fixing position on the mounting base and which the typewriter is to be subsequently secured, and a connecting member for connecting said fastening member to said bottom plate of said case, said connecting member having one end portion connected to said fastening member, said one end portion being completely enclosed by said fastening member and said mounting base, said connecting member not being accessible from the outside of the typewriter, said connecting member having another end portion connected to the exposed portion of said bottom plate, access to said other end portion being positively prevented by said cover when said cover is closed.

2. An apparatus according to claim 1, including means for rockably supporting said cover at one end on said case; and wherein said locking means includes tongue members which project from an opposite end of said cover and an engaging member part of which is connected to said case for locking engagement with said tongue members by actuation of a key.

3. An apparatus according to claim 2, wherein said opposite end of said cover has an edge which extends laterally of said case, and comprising two tongue members each of which projects from a different end portion of said edge wherein said tongue members are each formed with a groove in a direction substantially at right angles to the rocking direction of said cover; and said engaging member comprises an arm and a rod pivotally connected to said arm, so that when said arm is engaged with one of said tongue members by actuation of said key, said rod is simultaneously engaged with the other of said tongue members for locking said cover to said case.

4. An apparatus according to claim 1, wherein said fastening member is constructed and arranged to be fixed to said mounting base by an adhesive agent deposited on a surface of said fastening member which contacts said mounting base.

5. An apparatus according to claim 1, wherein said fastening member is of generally planar shape and has a middle portion made convex to define a certain space with respect to the mounting base, the middle convex portion being formed with a first bore at the center; and said connecting member comprises a circular plate arranged to be received in said certain space and having a diameter greater than that of said first bore, a shaft made integral at one end with said circular plate and arranged to project at an opposite end from said first bore of said fastening member and externally threaded at the opposite end, and a nut meshable with said external thread, so that said bottom plate of said case can be fixed between said fastening member and said nut through said shaft.

6. An apparatus according to claim 5, wherein said first bore formed in said fastening member is greater in diameter than said shaft, for permitting a movement of said shaft within said first bore.

7. An apparatus according to claim 6, wherein said bottom plate is formed with a second bore for permitting the insertion therethrough of a tip end portion of a tool in such a manner that said second bore is located adjacent to a third bore formed in said bottom plate; and said circular plate is formed with a recess for permitting said tool to be received therein, so that when said nut is fitted onto said shaft, said tool can be engaged with said second bore of said circular plate so as to prevent the rotation of said shaft about its axis.

* * * * *

UNITED STATES PATENT AND TRADEMARK OFFICE

CERTIFICATE OF CORRECTION

PATENT NO. : 4,509,874

DATED : April 9, 1985

INVENTOR(S) : HIRA et al

It is certified that error appears in the above-identified patent and that said Letters Patent is hereby corrected as shown below:

Column 4, (claim 1), line 48, after "closed; and" the reference numeral "pl" should be deleted and a new paragraph should begin with the word "fastening";

Column 4 (claim 1), line 56, after "mounting base" the word "and" should read --to--.

Signed and Sealed this

*Seventeenth* Day of *September 1985*

[SEAL]

*Attest:*

DONALD J. QUIGG

*Attesting Officer*

*Commissioner of Patents and Trademarks—Designate*